United States Patent [19]

Dingler et al.

[11] 4,228,962

[45] Oct. 21, 1980

[54] COMMINUTING LIQUID SWIRLER

[75] Inventors: Geoffrey L. Dingler, St. Joseph Township, Berrien County, Mich.; Philip P. Johnson, Conway, Ark.

[73] Assignee: Whirlpool Corporation, Belmont Harbor, Mich.

[21] Appl. No.: 48,444

[22] Filed: Jun. 14, 1979

[51] Int. Cl.[3] ..... B02C 18/40

[52] U.S. Cl. ..... 241/46 R; 241/92

[58] Field of Search ..... 134/104, 115 R, 115 G; 415/115, 121 B, 121 G; 210/512 R; 241/46 R, 46.06, 222, 92

[56] References Cited

U.S. PATENT DOCUMENTS

| | | | |
|---|---|---|---|
| 1,762,028 | 6/1930 | Phelps | 241/46 R X |
| 3,096,718 | 7/1963 | Anderson | 415/121 B |
| 3,214,019 | 10/1965 | Griffin | 210/512 R X |
| 3,271,929 | 9/1966 | Bowden et al. | 241/46 R X |
| 3,434,671 | 3/1969 | Cushing et al. | 241/46 R |
| 3,558,484 | 1/1971 | Carr | 210/512 R |
| 3,746,266 | 7/1973 | Knox et al. | 241/46 R |
| 3,815,827 | 6/1974 | Bradley | 241/46 R |
| 3,981,456 | 9/1976 | Hahn et al. | 241/46 R |
| 4,069,981 | 1/1978 | Shah | 241/222 X |

*Primary Examiner*—Mark Rosenbaum

*Attorney, Agent, or Firm*—Wegner, Stellman, McCord, Wiles & Wood

[57] ABSTRACT

A liquid swirler arranged to comminute relatively large solids so as to permit the comminuted solids to pass through openings in the swirler with a liquid flow induced therethrough. In the illustrated embodiment, the apparatus is utilized in a dishwasher having a pump for flowing dishwashing liquid through a flow passage of a centrifuge-type separator. The swirler effects a swirling movement of the liquid in the separator to permit the separator to remove the solids from the liquid before passing the liquid on to the pump. The swirler is arranged to provide the further function of breaking solids down to a small enough size to permit them to pass satisfactorily through the pump and dishwashing liquid circulation system. A resilient member is disposed adjacent the swirler to assist in breaking up relatively large solids by holding them suitably for comminuting action by the rotating swirler.

12 Claims, 2 Drawing Figures

COMMINUTING LIQUID SWIRLER

BACKGROUND OF THE INVENTION

1. Field of the Invention

This invention relates to liquid flow systems and in particular to such systems utilizing means for effecting a swirling movement to the liquid being flowed through a flow passage such as for use in effecting a centrifugal solid separation operation.

2. Description of the Prior Art

In one improved form of dishwashing liquid flow system, a portion of the dishwashing liquid being delivered to the circulation pump is bypassed to a soil separator by a centrifugal bypass flow operation. To effect such centrifugal operation, it is necessary to impart a swirling movement to the dishwashing liquid being flowed through a flow passage of the separator leading to the circulation pump. While the pump effects a longitudinal flow of dishwashing liquid through the flow passage, separate means must be provided to effect the desired swirling movement. The present invention is concerned with an improved means for effecting the desired swirling movement in such a liquid flow system.

The use of a screen for separating particles at the inlet to a fluid flow system is shown in U.S. Pat. No. 1,762,028 of Morton F. Phelps. As shown therein, the exhaust fan shaft is provided with a perforated disc, or screen member, which rotates with the blast wheel and functions to separate solid matter from the air drawn through the inlet opening so as to prevent that solid matter from contacting the blast wheel blades.

Roy N. Anderson shows, in U.S. Pat. No. 3,096,718, a trash cutter for a pump arranged to chop up foreign matter before it enters the interior of the pump so as to prevent clogging of the pump. The shearing of foreign matter is effected by a cutting element attached to the pump body adjacent the blades of the pump so that the pump blades themselves function as a portion of the cutting means.

Phil H. Griffin, III shows an overload controlled drilling mud treatment system in U.S. Pat. No. 3,214,019, wherein jamming of an intake screen by foreign matter causes disengagement of the pump from its power source. The pump water, however, is continued to be supplied to the discharge outlet of the screen housing for flushing purposes.

J. E. Bowden et al, in U.S. Pat. No. 3,271,929, show a reconditioner for used drilling mud utilizing rotating perforated cone discs for desanding and degassing the used drilling mud.

A pump for a dishwasher is shown in U.S. Pat. No. 3,434,671 of Donald S. Cushing et al, which pump is provided with a macerating means defined by a blade pivotally secured on the pump shaft upstream of a screen located across the pump inlet. The blade either macerates large particles held on the screen until they are small enough to pass through the openings thereof, or if the particles are unmacerable, the blade bats the particles from the screen.

In U.S. Pat. No. 3,558,484, Wayne F. Carr shows a fiber separating apparatus having a screen arranged to pass only acceptable clean fibers and liquid. To insure against plugging of the openings of the screen, a plurality of stationary blades, or foils, are mounted to extend generally radially of and lie adjacent the inboard surface of the screen.

In U.S. Pat. No. 3,981,456 of Thomas M. Hahn et al, a food particle macerating means is shown including a cutting arm attached to a helically wound column. The cutting arm coacts with a gridlike grating element to macerate the food particles. The macerating device is arranged to move over or slip around unmacerable food particles, such as particles of bone, and serves to dislodge unmacerable particles from the grating element and urge them into a suitable associated trap.

SUMMARY OF THE INVENTION

The present invention comprehends an improved liquid flow system such as for use in a dishwashing recirculation system wherein a swirling of the dishwashing liquid is desired in a separator flow passage so as to effect an automatic bypass separation of food particles and the like from the dishwashing liquid prior to the delivery of the dishwashing liquid to the pump of the circulation system.

The invention broadly comprehends the provision in a liquid flow system having means defining a flow passage and means for causing liquid flow through the flow passage of an improved swirling means for causing swirling movement of the liquid being flowed through the flow passage. The swirling means includes a wall member having distributed through openings for passing the liquid being flowed, and means for rotating the wall member about an axis parallel to the longitudinal extent of the flow passage for causing the portions of the wall member defining the edges of the opening to comprise means for comminuting large solids carried in the liquid to a small enough size to permit passage thereof through the openings with the liquid. The invention comprehends the provision in such a liquid flow system of means for preventing large solids caught on the upstream portion of the wall member from being maintained thereon thereby to prevent clogging of the openings by the large solids and effectively assure the desired comminuting action by the wall member on the solids and maintain swirling of the liquid in the flow passage.

The wall member may define a peripheral flange extending upstream thereon for retarding bypassing liquid flow about the periphery of the wall member for improved effective comminuting and swirling action in the apparatus.

The means for preventing the large solids caught on the upstream portion of the wall member from being maintained thereon may comprise a resilient member fixed closely upstream of the wall member and, in the illustrated embodiment, comprises a rubber block element defining a finger for intercepting the movement of the large particles carried on the wall member and holding the intercepted particles against the wall member to permit the desired comminuting action by the opening edge portions.

In the illustrated embodiment, the liquid flow system is utilized in a dishwasher having a pump for supplying washing liquid to a spray system for cleaning dishes, and a centrifugal separator for separating particles from the washing liquid as that liquid passes from the spray system to the pump. The centrifugal motion imparting mechanism includes an impeller having a plate wall provided with a plurality of openings and a flange extending substantially perpendicularly to the plate wall to form with the plate wall a cup-shaped member. The cup-shaped member is arranged to open into the flow of liquid passing to the pump and is rotated on a shaft driven by a motor so as to impart a swirling motion to the liquid flowing into the cup member and through the openings to the pump. A stationary resilient finger is mounted adjacent the plate wall holding the particles in the liquid against the rotating plate wall until they are small enough to pass through the openings.

The liquid flow system of the present invention is extremely simple and economical of construction while yet providing a highly improved swirling and comminuting action as discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
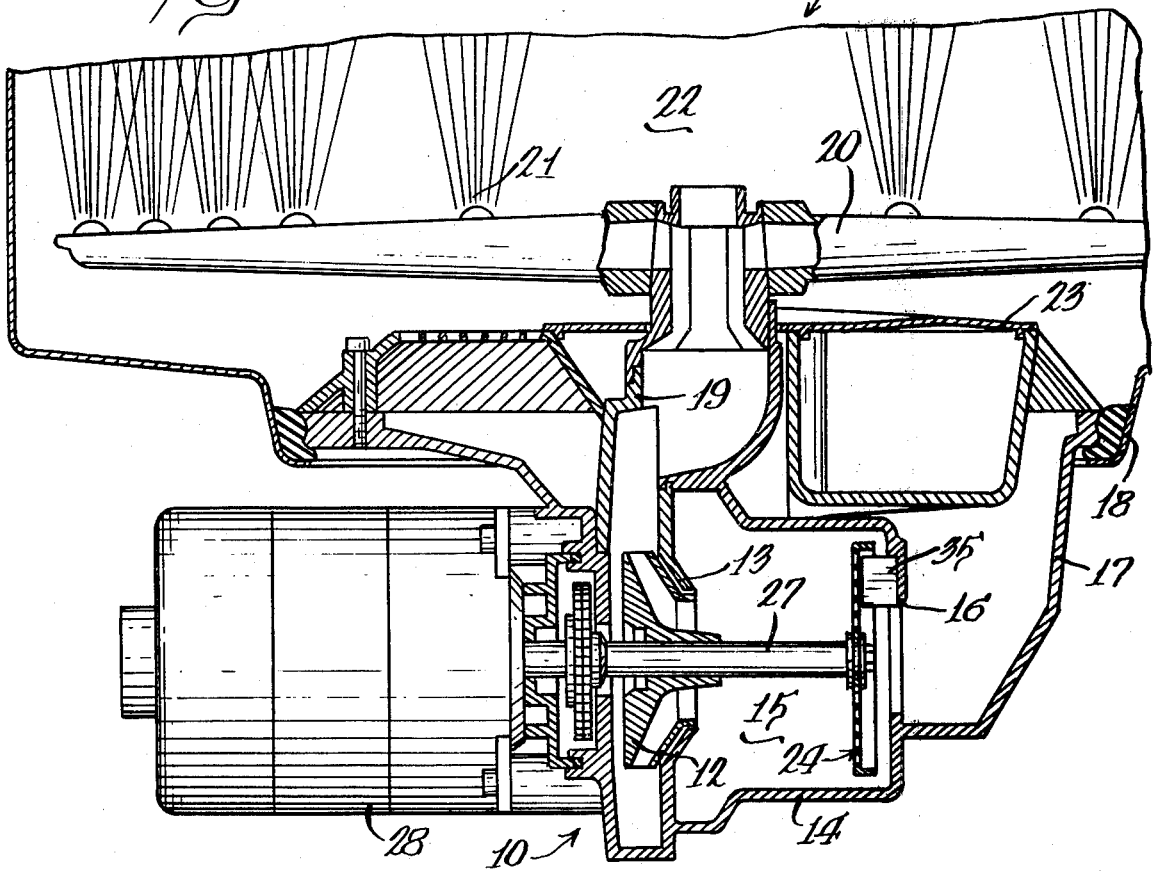
FIG. 1 is a fragmentary vertical section of a dishwasher apparatus having a liquid flow system embodying the invention.

In the exemplary embodiment of the invention as disclosed in the drawing, an improved liquid flow system generally designated 10 is shown as used in conjunction with an apparatus, such as a dishwasher apparatus, 11. As shown in FIG. 1, the dishwasher apparatus includes a recirculation impeller pump 12 at the outlet 13 of a separator 14 defining a flow passage 15.

Separator 14 further defines an inlet 16 which communicates with the sump 17 of the dishwasher tub 18 for receiving dishwashing liquid sprayed against dishes in the tub for recirculation thereof by pump 12. Thus, as further shown in FIG. 1, the outlet of pump 12 is defined by a return duct 19 communicating with a rotating spray arm 20 arranged to spray the dishwashing liquid in the form of spray jets 21 upwardly in a dishwashing space 22 for effecting further the dishwashing operation.

The dishwasher apparatus 11 may further include a soil accumulator 23 into which a portion of the liquid passing through flow passage 15 is bypassed for effecting separation of particulate matter, such as food particles and the like, from the liquid before returning it to the flow passage and subsequent delivery through the outlet opening 13 to the pump 12. To effect the bypass of the liquid and automatic separation of the food particles from the bypass liquid, the dishwashing liquid is swirled in the flow passage 15 by a swirling means 24 disposed inwardly of the separator inlet 16. The functioning of the accumulator as a result of the swirling movement of the liquid in flow passage 15 forms no part of the present invention and the description of the invention herein is confined to the specific improvement and to the elements as necessarily cooperate with it as necessary to a complete understanding of the present invention. A more complete explanation of the functioning of the accumulator is given in our co-pending application filed concurrently with this application entitled "DISHWASHER SOIL SEPARATOR" as Ser. No. 48,443.

Figure 2:
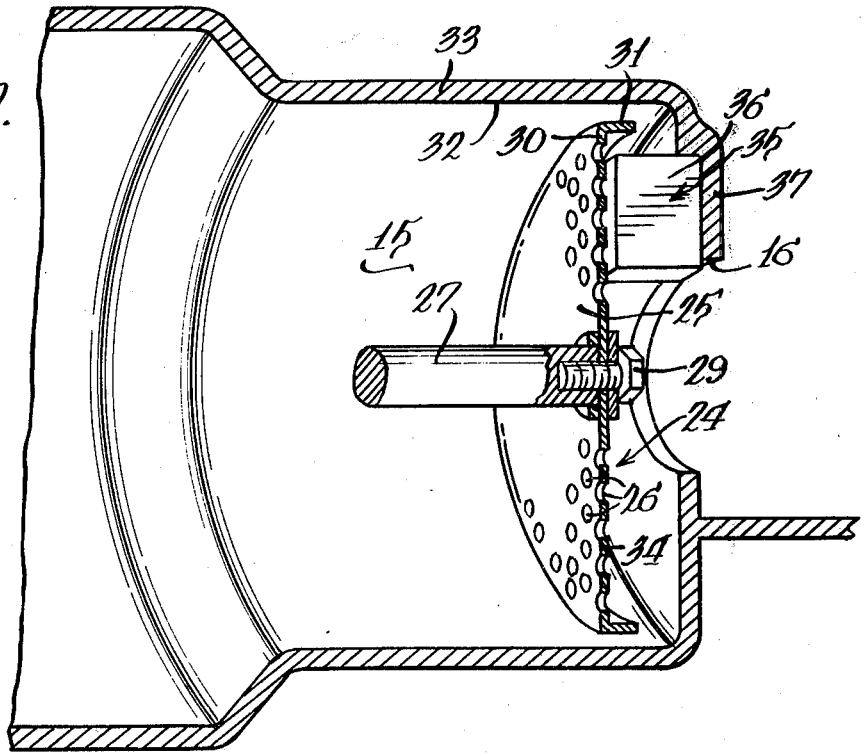
FIG. 2 is a fragmentary isometric sectional view illustrating in greater detail the liquid swirling and comminuting means of the invention.

More specifically, as seen in FIG. 2, swirling means 24 includes a plate member 25 provided with a plurality of through openings 26. The plate member is coaxially carried on the end of a shaft 27 of a drive motor 28, which shaft also carries the pump impeller 12, as shown in FIG. 1. As shown in FIG. 2, plate member 25 may be removably secured to the shaft end by a suitable threaded securing means, such as screw 29. In the illustrated embodiment, the plate member is circular having an outer periphery 30 provided with a turned annular flange 31.

Flange 31, as seen in FIG. 2, extends in an upstream direction substantially perpendicularly to the flat plane of the perforated plate member 25 and is spaced radially inwardly closely adjacent the inner wall surface 32 of the cylindrical sidewall 33 of separator flow passage 15. Thus, flange 31 effectively retards bypassing of liquid from inlet 16 around the swirling means 24.

As indicated above, in normal operation, solids, such as food particles and the like, may be entrained in the dishwashing liquid being returned from the tub 18 to the pump 12 for recirculation through the spray arm 20. It is desirable to prevent transmission to the pump 12 of relatively large particles which could otherwise clog the pump. Thus, the openings 26 in the swirling means have a preselected size corresponding to the maximum size of food particles desired to be permitted to be passed to the pump 12.

The soil particles which may be larger than the openings 26 may tend to collect on the upstream face 34 of the plate member 25 clogging the openings 26 and preventing the desired swirling flow of the dishwashing liquid through the flow passage 15. To effectively prevent such clogging action, means generally designated 35 are provided which, in the illustrated embodiment, comprise a resilient finger, or block, 36 fixedly secured to a portion 37 of the separator wall at inlet 16 so as to be spaced in close juxtaposition to the plate member surface 34 and, thus, intercept the path of movement of the relatively large particles temporarily held on the plate member surface. The finger 36 effectively holds these large particles stationary to permit the continuing rotation of the perforated plate member to act as a comminuting means in comminuting the held soil matter until it is sufficiently small to pass through the openings 26 with the flowing dishwashing liquid. As indicated briefly above, these now small size soil particles may be effectively separated from the dishwashing liquid and accumulated in accumulator 23 so as to provide an improved dishwashing operation. At the same time, the breaking up of the large particles so as to permit them to pass through the openings 26 effectively maintains a clog-free condition of the plate member 25 so as to assure the desired swirling flow of the dishwashing liquid in the flow passage 15.

As seen in FIG. 2, at least a portion of the finger 36 is disposed radially inwardly of the flange 31. In the illustrated embodiment, the finger 36 comprises a block of resilient rubber. As further seen in FIG. 2, inlet opening 16 may be relatively small compared to the outer diameter of the plate member 25 whereby a substantial portion of the incoming dishwashing liquid impinges first against the midportion of the plate member secured to the end of the drive shaft 27.

Thus, the use of the dish-shaped plate member 25 and the flexible holding means 35 effectively defining a chopper structure in cooperation with the apertured plate member 25, provides both a desired swirling movement of the dishwashing liquid through the flow passage 15 and the maintained unclogged condition of the swirling means plate member 25. In this capacity, the edges of the plate member defining the openings 26 cooperating with the resilient block 36 in effecting the desired comminuting or chopping action of the relatively large soil particles.

The foregoing disclosure of specific embodiments is illustrative of the broad inventive concepts comprehended by the invention.

We claim:

1. In a dishwasher having a pump for supplying washing liquid to a spray system for cleaning dishes and a centrifugal separator for separating particles from the washing liquid as said liquid passes from said spray system to said pump, swirling and chopping means for causing swirling movement of the liquid being flowed through said flow passage and chopping of solids carried by the liquid, said swirling and chopping means comprising:

a wall member having distributed through openings for passing the liquid being flowed, and means for rotating the wall member about an axis parallel to the longitudinal extent of the flow passage for causing the portions of the wall member defining the edges of the openings to comprise means for chopping and thereby comminuting large solids carried in the liquid to a small enough size to permit passage thereof through said openings with said liquid; and holding means adjacent the wall member for preventing unchopped large solids caught on the upstream portion of the wall member from being carried therewith thereby to prevent clogging of the openings by said large solids, said holding means further cooperating with the wall member for causing chopping of the large solids and thereby effectively assuring comminuting action by the wall member on substantially all large solids for maintained swirling of the liquid in the flow passage.

2. The dishwasher structure of claim 1 wherein said wall member defines a peripheral flange extending upstream thereon for retarding bypassing liquid flow about the periphery of the wall member.

3. The dishwasher structure of claim 1 wherein said flow passage has a circular cross section, said wall member is circular and defines an annular peripheral flange extending upstream thereon for retarding bypassing liquid flow about the periphery of the wall member.

4. The dishwasher structure of claim 1 wherein said means for preventing large solids caught on the upstream portion of the wall member from being maintained thereon comprises a resilient member fixed closely upstream of said wall member.

5. In a dishwasher having a pump for supplying washing liquid to a spray system for cleaning dishes and a centrifugal separator for separating particles from the washing liquid as said liquid passes from said spray system to said pump, a centrifugal motion imparting mechanism for said separator comprising:

an impeller having a plate wall provided with a plurality of flow conducting openings, said impeller having a flange extending substantially perpendicularly to said plate wall to form with said plate wall a cup-shaped member, said cup-shaped member opening into the flow of liquid passing to said pump;

a shaft;

motor means for rotating said shaft to rotate said impeller and thereby impart a swirling motion to said liquid flowing into said cup-shaped member and through said openings; and a stationary resilient finger closely adjacent said plate wall for engaging and holding large particles carried by said rotating plate wall to cause the large particles to be chopped by the action of the rotating wall openings on the held particles.

6. The dishwasher structure of claim 5 wherein said finger comprises a rubber block.

7. The dishwasher structure of claim 6 wherein said finger is disposed at least partially radially inwardly of said flange.

8. In a dishwasher having a pump for supplying washing liquid to a spray system for cleaning dishes and a centrifugal separator for separating particles from the washing liquid as said liquid passes from said spray system to said pump, a centrifugal liquid swirling and particle chopping mechanism for said separator comprising:

a dish-shaped member having a peripheral sidewall, and a bottom wall provided with perforations sized to allow only the passage of particles that can pass through said pump, said sidewall effectively preventing the passage of particles around the periphery of said dish-shaped member;

motive means for rotating said dish-shaped member to produce a swirling motion in said washing liquid; and a flexible particle holding member closely adjacent said bottom wall for holding large particles stationary against said rotating bottom wall, said rotating perforations defining means interacting with said holding member to chop said large particles to a size sufficiently small to allow passage of said chopped particles through said bottom wall perforations to said separator.

9. The dishwasher structure of claim 8 wherein said particle holding member comprises a resilient finger.

10. The dishwasher structure of claim 8 wherein said particle holding member comprises a resilient finger disposed at least partially radially within said peripheral sidewall.

11. The dishwasher structure of claim 8 wherein said motive means also comprises means for driving said pump means.

12. The dishwasher structure of claim 8 wherein said separator defines an inlet opening coaxially upstream of said dish-shaped member and having a cross-sectional size substantially smaller than that of the dish-shaped member.

* * * * *